US006471579B1

(12) United States Patent
Blackshear

(10) Patent No.: US 6,471,579 B1
(45) Date of Patent: Oct. 29, 2002

(54) WORKSTATION FOR CONTAINING ORGANIC AND INORGANIC VAPOR CONTAMINANTS

(76) Inventor: Mary Jane Blackshear, 1190 N. State St. #267, Ukiah, CA (US) 95482

( * ) Notice: Subject to any disclaimer, the term of this patent is extended or adjusted under 35 U.S.C. 154(b) by 0 days.

(21) Appl. No.: 09/503,775

(22) Filed: Feb. 14, 2000

Related U.S. Application Data

(60) Provisional application No. 60/120,306, filed on Feb. 16, 1999.

(51) Int. Cl.[7] ..... B08B 15/02

(52) U.S. Cl. ..... 454/56

(58) Field of Search ..... 454/56, 187; 96/55; 132/73, 73.5

(56) References Cited

U.S. PATENT DOCUMENTS 4,553,992 A * 11/1985 Boissinot et al. ..... 454/56 X
5,112,373 A * 5/1992 Pham ..... 454/56 X
5,787,903 A * 8/1998 Blackshear ..... 454/56 X
5,904,896 A * 5/1999 High

FOREIGN PATENT DOCUMENTS

JP 2787465 * 6/1998

* cited by examiner

*Primary Examiner*—Harold Joyce
(74) *Attorney, Agent, or Firm*—William Michael Hynes; Townsend and Townsend and Crew, LLP

(57) ABSTRACT

An apparatus and process includes a workstation where a technician during normal operation generates organic and inorganic contaminants. The workstation includes a work surface with an hood portion covering the work surface and defining a controlled air volume there above the work surface. At least one defined hand and arm entry port permits access into the controlled air volume. A transparent portion is defined through the hood portion to permit a person using the arm entry to observe working of inserted hands within the controlled air volume. At least one air vent is communicated to the controlled air volume for withdrawing air from the controlled volume. This withdrawal occurs to an air processing section for withdrawing air from the controlled air volume whereby air enters at least through the arm entry. The improvement to the workstation includes an ozone generator, and at least one outlet at the hood portion for distributing ozone at a rate to oxidized the organic and inorganic contaminates produced with the workstation. It is preferred that the ozone is negatively charged, and distributed through a manifold from the top of the controlled air bottom. A preferred embodiment of this invention includes a manicure workstation.

9 Claims, 2 Drawing Sheets

WORKSTATION FOR CONTAINING ORGANIC AND INORGANIC VAPOR CONTAMINANTS

CROSS-REFERENCES TO RELATED APPLICATIONS

This Application claims priority from Provisional U.S. patent application Ser. No. 60/120,306 filed Feb. 16, 1999.

BACKGROUND OF THE INVENTION

This application relates to workstations where organic and inorganic contaminants are produced. In the usual situation, such contaminants are buoyant with respect to ambient air. As a result, the contaminants float upward and into the respiratory system of the worker. It is the purpose of this disclosure to safely dispose of such contaminants.

I have discovered that mere filtration is insufficient for many such contaminants. Thus, passage through filters, ionizing stations, and the like is generally insufficient. Further treatment is required.

The process of applying artificial fingernails is exemplary and generates organic and inorganic vapors, as well as numerous vaporous contaminants. Known chemical contaminants for which there is a permissible exposure limit include: acetone, acetonitrile, benzoyl peroxide, ethyl acetate, ethyl ether, hydroquinone, methacrylic acid, 4-methoxyphenol, methylene chloride, methyl ethyl ketone, titanium dioxide, toluene, and 1,1,2-trichloro-1,2,2-trifluoroethane. Chemicals found in artificial nail products for which there are no permissible exposure limits include: butyl methacrylate, dimethyl p-toluidine, ethyl cyanoacrylate, ethyl methacrylate, ethylene glycol dimethacrylate, and isobutyl methacrylate.

Manicure workstations typically include a ventilation system, which attempts to keep the air clean of such contaminants. When properly designed and installed, local exhaust systems (such as vented table systems) capture and remove most contaminants before they reach the air that the technician and customer breathe. Most known ventilation systems are designed to vent contaminated air to the outside, rather than inside the beauty salon. Systems that do re-circulate the air within the beauty salon generally include a charcoal filter and a dust filter, both of which should both be changed frequently. However, ordinary dust filters do not remove the above toxic vapors from the air.

SUMMARY OF THE INVENTION

An apparatus and process includes a workstation where a technician during normal operation generates organic and inorganic contaminants. The workstation includes a work surface with an hood portion covering the work surface and defining a controlled air volume there above the work surface. At least one defined hand and arm entry port permits access into the controlled air volume. A transparent portion is defined through the hood portion to permit a person using the arm entry to observe working of inserted hands within the controlled air volume. At least one air vent is communicated to the controlled air volume for withdrawing air from the controlled volume. This withdrawal occurs to an air processing section for withdrawing air from the controlled air volume whereby air enters at least through the arm entry. The improvement to the workstation includes an ozone generator, and at least one outlet at the hood portion for distributing ozone at a rate to oxidized the organic and inorganic contaminates produced with the workstation. It is preferred that the ozone is negatively charged, and distributed through a manifold from the top of the controlled air bottom. A preferred embodiment of this invention includes a manicure workstation.

DESCRIPTION OF THE SPECIFIC EMBODIMENTS

Figure 1:
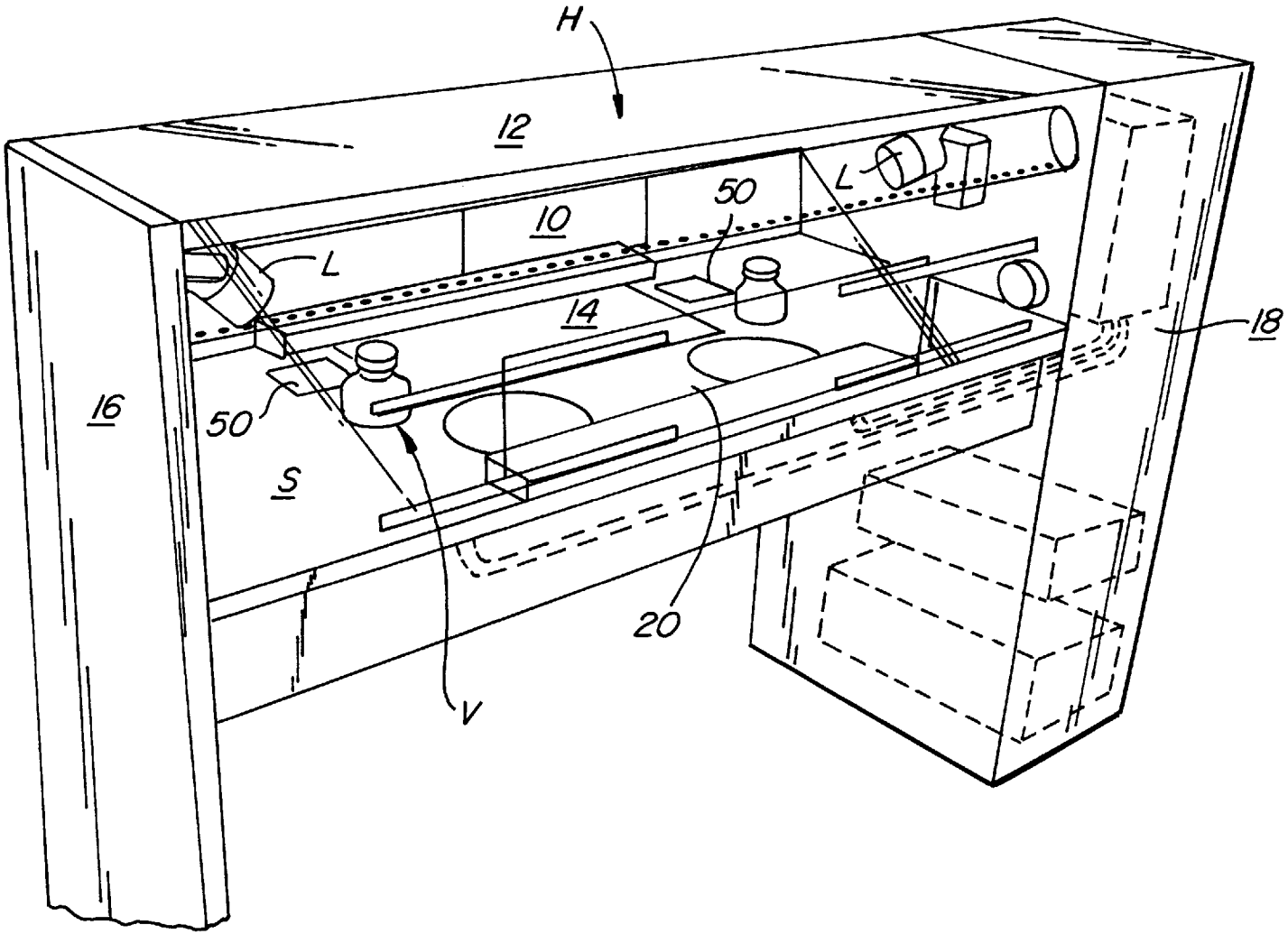
FIG. 1 is a perspective schematic of the workstation according to this invention, the workstation illustrated as a manicure workstation; and, FIG. 2 is a block diagram of the inner fluid flow within the workstation of FIG. 1.

Referring to FIG. 1, manicure workstation W similar to that disclosed in my Blackshear U.S. Pat. No. 5,787,903 issued Aug. 4, 1998 is disclosed. Simply stated, work surface S has transparent hood H covering the work surface S to define controlled air volume V. At the respective ends, controlled air volume V is bounded by side 16 and cabinet 18 which preferably contains the active apparatus utilized with the workstation and the process of use for the workstation.

The workstation W includes at least one hand and arm entry port 20. In the case of the preferred manicure workstation W, it is necessary to have two such ports, one for the client and one for the technician. It will be understood that the workstation here disclosed can be used for other purposes. For example, certain electronic and micro-machine assembly stations could use this technology as well. In these latter cases, only one arm entry port will be required. As in the usual case, suitable lighting L can be supplied.

Having set forth this much, reference will now be made to the schematic of FIG. 2. Thereafter, operation of the workstation will be described.

Figure 2:
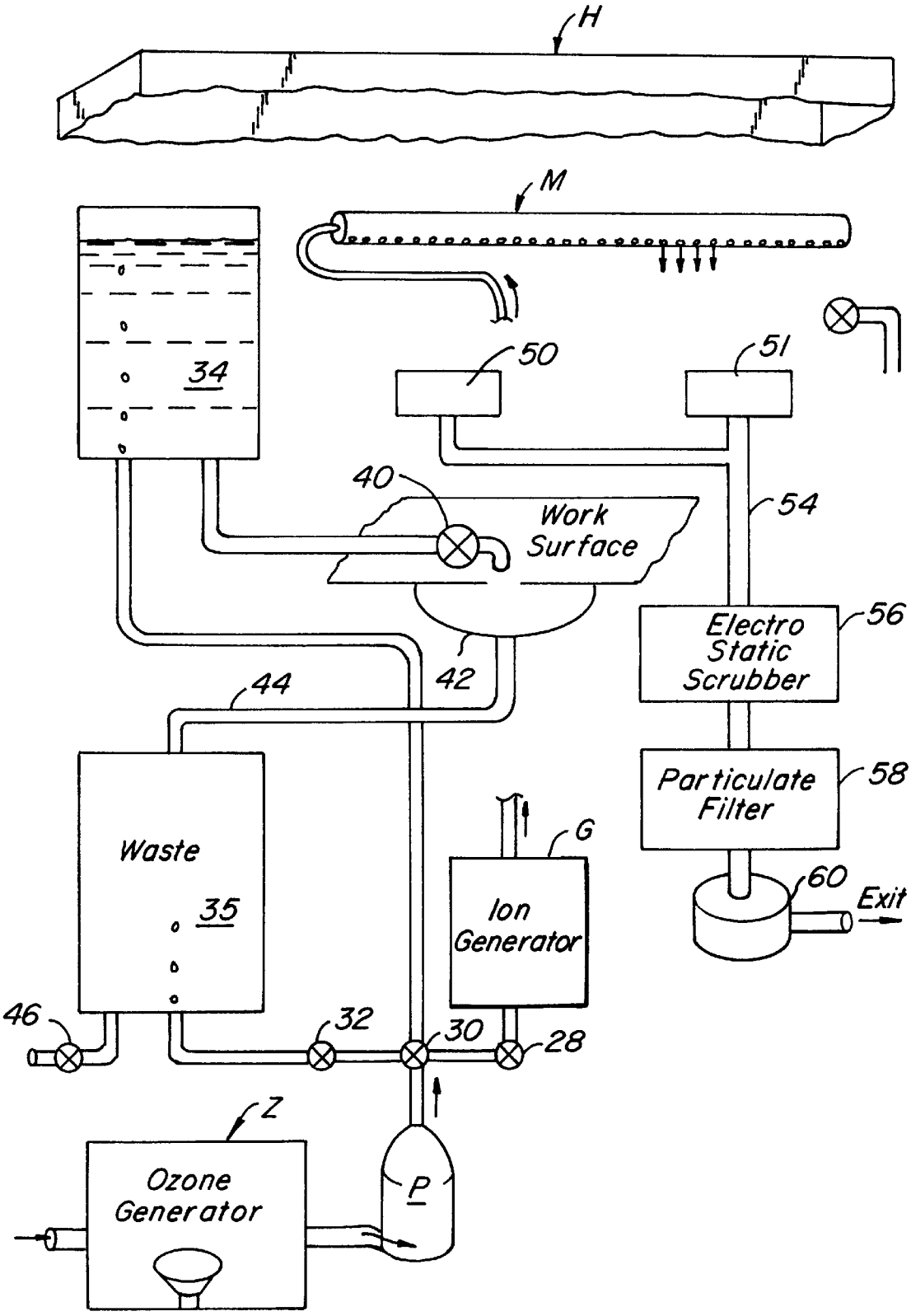

Referring to FIG. 2, transparent hood H is schematically shown. Ozone generator Z is shown discharging generated ozone O to air pump P. The ozone generator Z is of extremely simple construction. It is a standard hot tub ozone generator sold under the trademark "SPA King Bubble Gun II" which generates approximate 3 grams per hour of ozone.

Pump P is a standard vibrating aquatic fish pump of the type used in small aquariums. It has been modified at the intake to receive the generated and negatively charged ozone. It discharges to three valve manifold 26.

First, three valve manifold 26 at valve 28 outputs to ion generator G which is again a standard item of manufacture which can be purchased from Electrocorp of Cotati, Calif. This effectively negatively charges the ozone. Thereafter, the ozone is distributed to manifold M under transparent hood H within controlled air volume V.

A word about the interaction of produced organic and inorganic contaminants under transparent hood H. First, and when chemicals containing such contaminants are utilized under transparent hood H, the contaminants can be described as being upwardly buoyant in air. At the same time, the ozone is released downward from manifold M. Oxidation occurs. Further, in the oxidized format, I have found that the contaminants generated are readily removed. For example, there is no perceptible odor emanating from my workstation W.

In the case of the preferred manicure workstation W, I have found it desirable to treat both fresh and waste water with ozone. Accordingly, I have valve 30 releasing sufficient ozone to bubble through fresh water supply 34. Further, valve 32 discharges ozone through waste water receptacle 35. Water is provided to workstation W through outlet spicket 40 to sink 42 through drain 44 to waste water receptacle 35. Given sufficient time for waste water treatment by ozone, waste water outlet 46 can discharge the retained waste water.

Finally, work surface S is provided with at least one vent 50, with a second vent 51 here being shown. The vents discharge through conduits 54 to electrostatic scrubber 56 and particulate filter 58 through fan 60 for discharge to atmosphere, such as a department store where the workstation W is located.

Returning to FIG. 1, the reader will understand that cabinet 18 standing to one side of workstation W is an ideal location for the components illustrated in FIG. 2. Such components are only schematically shown in broken lines; the flow diagram of FIG. 2 sets forth the preferred layout.

Operation can now be simply set forth. Assuming that all illustrated generators, pumps and fans of FIG. 2 are operating, work within controlled air volume V will generate organic and inorganic contaminants, which in the usual case will be upwardly buoyant in air. Ozone supplied from manifold M will fall from the top of transparent hood H and essentially counter flow with the contaminants. Oxidization will occur. Thereafter, electrostatic filtering and particulate filtering will follow with discharge to atmosphere.

It will be understood that this invention will admit of modification.

What is claimed is:

1. In a workstation for use by a technician where organic and inorganic contaminants are used, the workstation comprising in combination:

a work surface;

an hood portion covering the work surface and defining a controlled air volume there above;

at least one a defined hand and arm entry port into the controlled air volume;

a transparent portion defined through the hood portion to permit a person using the arm entry to observe working of inserted hands into the controlled air volume;

at least one air vent communicated to the controlled air volume for withdrawing air from the controlled volume; and, an air processing section communicated to controlled air volume through the at least one air vent for withdrawing air from the controlled air volume whereby air enters at least through the arm entry to prevent the exit of air through the arm entry;

the improvement to the workstation comprising:

an ozone generator; and, at least one outlet at the hood portion for distributing ozone at a rate to oxidized the organic and inorganic contaminates produced with the workstation.

2. The workstation for use by a technician where organic and inorganic contaminants are used according to claim 1 and further wherein:

the ozone generator includes means for negatively charging the ozone.

3. The workstation for use by a technician where organic and inorganic contaminants are used according to claim 1 and further wherein:

the ozone is distributed at the top of the hood portion by a manifold.

4. A workstation for use by a technician where organic and inorganic contaminants are used, the workstation comprising in combination:

a work surface;

an hood portion covering the work surface and defining a controlled air volume there above;

at least one a defined hand and arm entry port into the controlled air volume;

a transparent portion defined through the hood portion to permit a person using the arm entry to observe working of inserted hands into the controlled air volume;

at least one air vent communicated to the controlled air volume for withdrawing air from the controlled volume; and, an air processing section communicated to controlled air volume through the at least one air vent for withdrawing air from the controlled air volume whereby air enters at least through the arm entry to prevent the exit of air through the arm entry;

an ozone generator; and, at least one outlet at the hood portion for distributing ozone at a rate to oxidized the organic and inorganic contaminates produced with the workstation.

5. The workstation for use by a technician where organic and inorganic contaminants are used according to claim 4 and wherein:

at least one container for water is maintained at the workstation; and, means for distributing ozone through the water is present at the workstation.

6. The workstation for use by a technician where organic and inorganic contaminants are used according to claim 5 and the at least one container for water is for containing waste water.

7. The workstation for use by a technician where organic and inorganic contaminants are used according to claim 5 and where:

the at least one container for water is for containing fresh water.

8. A process of using a workstation where organic and inorganic contaminants are used, the process comprising the steps of:

providing a work surface;

providing an hood portion covering the work surface and defining a controlled air volume there above;

providing at least one a defined hand and arm entry port into the controlled air volume;

providing a transparent portion defined through the hood portion to permit a person using the arm entry to observe working of inserted hands into the controlled air volume;

providing at least one air vent communicated to the controlled air volume for withdrawing air from the controlled volume;

providing an air processing section communicated to controlled air volume through the at least one air vent for withdrawing air from the controlled air volume whereby air enters at least through the arm entry to prevent the exit of air through the arm entry;

providing an ozone generator;

working within the controlled air volume to produced organic and inorganic contaminants, distributing ozone at a rate to oxidized the organic and inorganic contaminates produced with the workstation; and, collecting the ozone, organic and inorganic contaminants to the air processing section.

9. The process of using a workstation where organic and inorganic contaminants are used according to claim 8 and wherein the step of providing the ozone includes:

providing negatively charged ozone.

* * * * *